US005265886A

United States Patent [19]

Hum

[11] Patent Number: 5,265,886

[45] Date of Patent: Nov. 30, 1993

[54] SHUTTLECOCK

[76] Inventor: Kyrac Hum, 8105 Sandy Spring Dr., Gaithersburg, Md. 20877

[21] Appl. No.: 11,774

[22] Filed: Feb. 1, 1993

[51] Int. Cl.[5] ..... A63B 67/18

[52] U.S. Cl. ..... 273/417; 446/418

[58] Field of Search ..... 273/417; 446/397, 418, 446/481

[56] References Cited

U.S. PATENT DOCUMENTS

| | | | |
|---|---|---|---|
| 578,491 | 3/1897 | Knowles | 446/418 X |
| 2,130,427 | 9/1938 | Hoover | 446/418 |
| 2,911,219 | 1/1957 | Arokiasamy | 273/417 |
| 3,120,717 | 2/1964 | Glass et al. | 446/481 X |
| 3,834,705 | 9/1974 | Wong | 273/417 |
| 3,901,509 | 8/1975 | Liong | 273/417 |
| 4,253,657 | 3/1981 | Rozzelle | 446/418 X |
| 4,813,686 | 3/1989 | Miranda | 273/417 |
| 4,995,617 | 2/1991 | Hwang | 273/417 |

*Primary Examiner*—Paul E. Shapiro

*Attorney, Agent, or Firm*—Shoemaker and Mattare, Ltd.

[57] ABSTRACT

A shuttlecock comprises a tail constructed from a plurality of feathers whose shafts are bound together, a head affixed to the feathers at their quills, and a spring formed from a stack of annular spring plates. Each plate surrounds the feather shafts above the head and is movable along the shafts. A retainer affixed to the feather shafts maintains the spring in a partially compressed state between the retainer and the head. When the head of the shuttlecock is struck, the spring plates produce a springing action and an audible click.

18 Claims, 2 Drawing Sheets

SHUTTLECOCK

BACKGROUND OF THE INVENTION

This invention is directed to amusements and sporting equipment generally, and more particularly to a shuttlecock designed to be struck with the foot, knee, or other parts of the body.

Most people are familiar with the small shuttlecock used in badminton; however, other, generally larger shuttlecocks have been proposed in the past for play without a racket. One such example is shown in U.S. Pat. No. 2,911,219, wherein a shuttlecock is disclosed having a head made of a stack of paper sheets, and a tail of feathers. The present invention is an improvement over the prior shuttlecock, in that it provides improved spring action and sound when struck.

SUMMARY OF THE INVENTION

An object of the invention is to provide a shuttlecock that is easily played or dribbled by one or more players.

Another object of the invention is to provide a shuttlecock of simple, durable construction.

A further object of the invention is to provide a shuttlecock which produces a distinctive sound when struck.

These and other objects are attained by a shuttlecock having a tail constructed from a plurality of feathers whose shafts are bound together, a head affixed to the feathers at their quills, a spring formed from a stack of annular spring plates, each plate surrounding the feather shafts above the head and being movable along the shafts, and a retainer affixed to the feather shafts, for maintaining the spring in a partially compressed state between the retainer and the head.

BRIEF DESCRIPTION OF THE DRAWINGS

In the accompanying drawings.

DESCRIPTION OF THE PREFERRED EMBODIMENT

Figure 1:
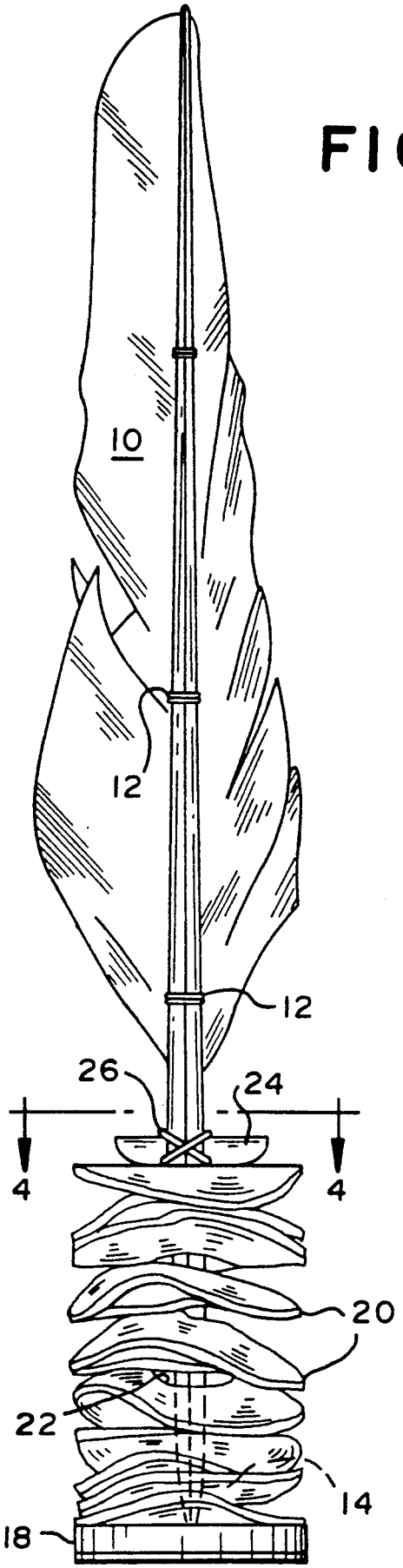
FIG. 1 is a front elevation of a first embodiment of the invention.
Figure 3:
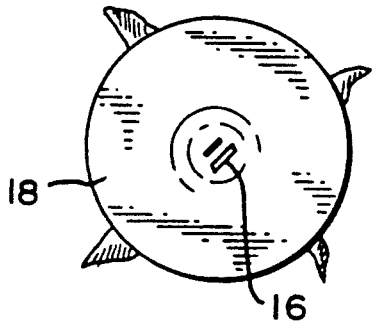
FIG. 3 is a bottom plan view thereof.

As shown in FIGS. 1–4, a shuttlecock embodying the invention is constructed from a number of—preferably four—feathers 10 whose shafts are bound together by thread 12 at intervals along the shafts. The quills 14 (FIG. 1) of the feathers are attached by sewing stitches 16 to the center of a soft disc 18 forming the head of the shuttlecock. The disc may be made of foam, leather, or any other material, although the head material is preferably soft. The disc is preferably about one and one-half inches (about 38 mm) in diameter, and about one-fourth inch (6 mm) thick.

Just above the disc 18, and bearing against it, are a stack of spring plates 20, the same diameter as the disc. These plates are preferably produced from the scale of a large-scaled fish; but they could alternatively be made from a plastic material, such as a high density polyethylene, as described further below.

Each spring plate is about one millimeter thick, and has a center hole 22 about a half inch (12.5 mm) in diameter, which is substantially greater than the diameter of the bound feather shafts, so that the spring plates can move freely up and down the shafts. Each spring plate is not flat, but rather, bent somewhat (either naturally, in the case of fish scales, or during manufacture if from synthetic material). When scales are use, the free height of each is about a quarter inch. The plates are installed in random orientations, so that they form a compressible stack whose free height is about 1.70 inches. When the stack is compressed, the plates are substantially flattened, as shown in FIG. 2.

Figure 4:
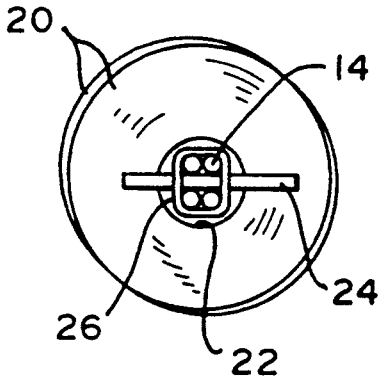
FIG. 4 is a sectional view taken along the line 4—4 in FIG. 1.
Figure 2:
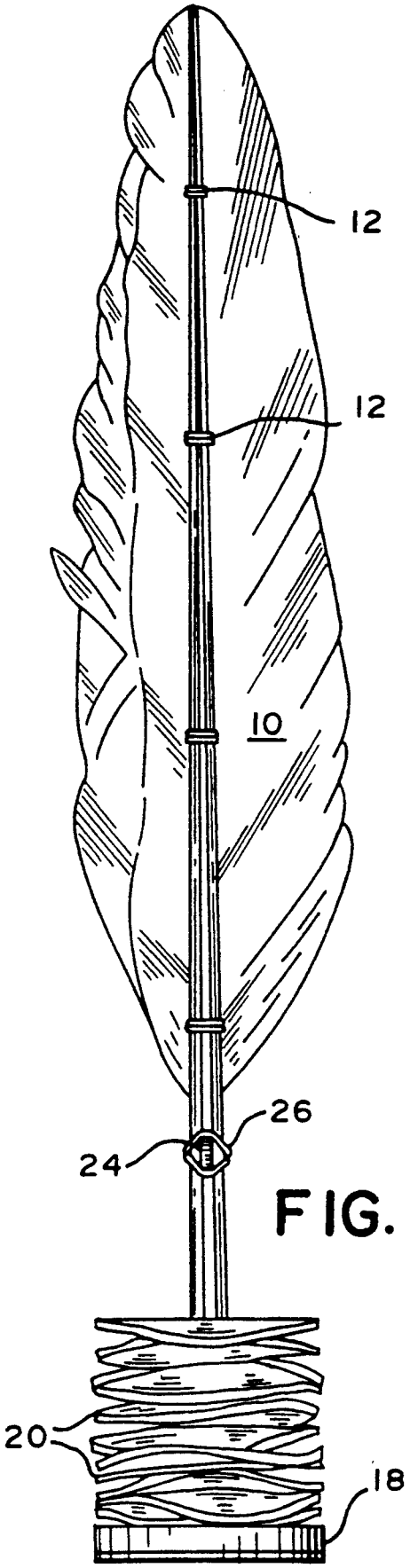
FIG. 2 is a side elevation thereof, with the stack of spring plates of the invention fully compressed.

The stack of spring plates is normally kept in a partially compressed state by a retainer 24, which itself is secured to and between the shafts of the feathers, as shown in FIGS. 2 and 4, by a small rubber band 26 stretched tightly over and under the retainer. The retainer is preferably cut from the same material that the spring plates are made of, but could be made of any suitable material.

The stack of disks function somewhat as a compression spring, having an installed height of about 1.56 inches, a binding height of about 0.75 inch, and a spring rate of about 80 ounces per inch. Unlike a simple coil spring, the plates can move out of contact with one another at times. This is believed to account for the attractive "click" produced when (or perhaps an instant after) the head of the shuttlecock is struck.

When made of the preferred materials mentioned above, the shuttlecock has a total weight of about one ounce. Most of the mass is in the spring plate stack, and the center of gravity lies within the stack. Changes in the spring rate will likely be indicated for shuttlecocks of different weights.

Figure 5:
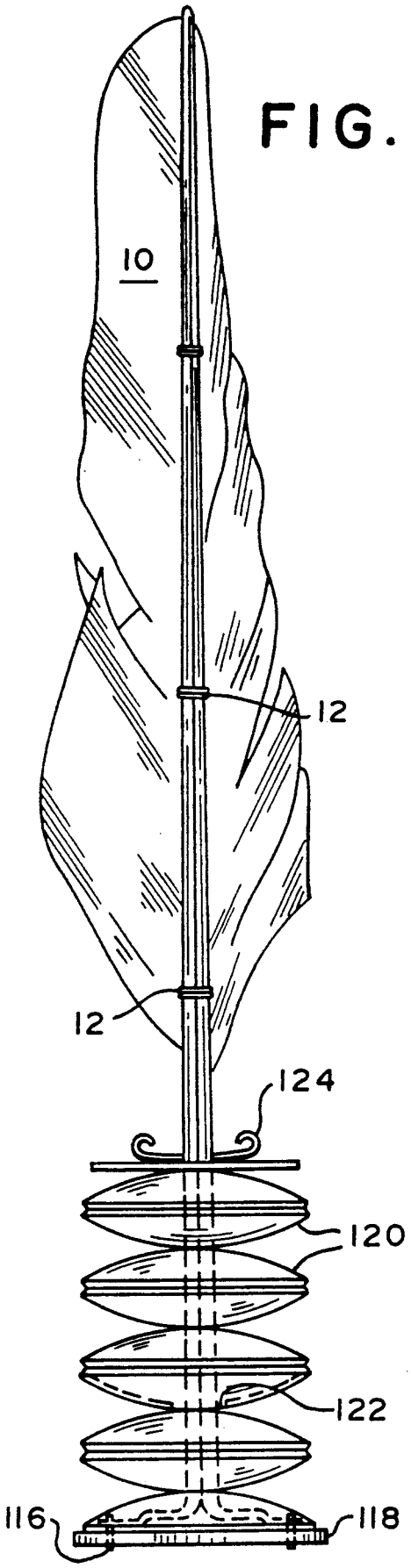
FIG. 5 is a view, corresponding to FIG. 1, of a second embodiment of the invention.

The parameters set out in the preceding paragraphs should enable one to construct suitable spring plates from various synthetic materials. A preferred example of such a modification is shown in FIG. 5. This embodiment differs from that of FIGS. 1–2 in that the spring elements 120 are a series of about ten identical hard plastic elements, with alternating orientation. Each has upper and lower surfaces which are substantially spherical segments. Each element has a central through hole 122 about a half inch in diameter, through which the quills pass. The quill tips are flattened, and bent outward as shown by FIG. 5, so that their ends may be held flat against the upper surface of the head 118 individually, by stitches 116. The retainer 124 illustrated is a metal wire clip that limits upward motion of the top plate. As the embodiments illustrate, it is possible to vary details and materials of the invention considerably. Additionally, while natural feathers are presently preferred, it is expected that synthetic "feathers" may be substituted. The following claims are intended to embrace all such variations.

The shuttlecock is intended to be played, by one or more people, using the foot, knee, hand, or any part of the body, with the idea of keeping the shuttlecock airborne.

Since the invention is subject to modifications and variations, it is intended that the foregoing description and the accompanying drawings shall be interpreted as illustrative of only one form of the invention, whose scope is to be measured by the following claims.

I claim:

1. A shuttlecock comprising a tail comprising a plurality of feathers having shafts terminating at quills, the shafts being bound together, a head affixed to the feathers at their quills, a spring comprising a stack of annular spring plates, each plate loosely surrounding the feather shafts above the head, and a retainer affixed to the feather shafts, or maintaining the spring in a partially compressed state between the retainer and the head.

2. The invention of claim 1, wherein the head is a disc of predetermined diameter, and each of said spring plates has approximately the same outer diameter as the disc.

3. The invention of claim 2, wherein said outer diameter is about one and one-half inches.

4. The invention of claim 3, wherein each of said spring plates has an inner diameter of about one-half inch.

5. The invention of claim 3, wherein each of said spring plates has a thickness of about one millimeter.

6. The invention of claim 1, wherein each of said spring plates is substantially non-planar.

7. The invention of claim 6, wherein each of said spring plates has a free height of about one-quarter inch.

8. The invention of claim 1, wherein at least some of said spring plates are substantially non-planar.

9. The invention of claim 1, wherein said spring has a spring rate of about 80 ounces per inch.

10. The invention of claim 1, wherein said spring has a free length of about 1.70 inches.

11. The invention of claim 10 wherein said retainer is spaced from said head by about 1.56 inches, so as to keep the spring stack in said partially compressed state.

12. The invention of claim 1, wherein each of said plates is formed from a fish scale.

13. The invention of claim 1, wherein each of said plates is med from a hard plastic material.

14. The invention of claim 13, wherein said plastic material is a high density polyethylene.

15. The invention of claim 1, wherein said head is formed of a soft, flexible material about one-quarter of an inch thick.

16. The invention of claim 15, wherein said head comprises a layer of a foam material.

17. The invention of claim 15, wherein said head comprises a layer of leather.

18. The invention of claim 1, wherein the quills are flattened and spread radially outward, each being individually stitched to said head.

* * * * *